US005826482A

United States Patent [19]

Rowe

[11] Patent Number: 5,826,482

[45] Date of Patent: Oct. 27, 1998

[54] HYDRAULIC ACTUATOR

[75] Inventor: Alexander William Rowe, Johannesburg, South Africa

[73] Assignee: Vector Hydraulics Incorporated, Geneva, Switzerland

[21] Appl. No.: 757,510

[22] Filed: Nov. 27, 1996

Related U.S. Application Data

[60] Provisional application No. 60/007,562 Nov. 27, 1995.

[51] Int. Cl. [6] ..... F01B 7/18; F01L 25/02

[52] U.S. Cl. ..... 91/235; 91/276; 91/318; 91/322

[58] Field of Search ..... 91/235, 276, 298, 91/322

[56] References Cited

U.S. PATENT DOCUMENTS

| | | | |
|---|---|---|---|
| 3,583,158 | 6/1971 | Foster et al. | 91/235 |
| 4,450,920 | 5/1984 | Krasnoff et al. . | |
| 5,222,452 | 6/1993 | Maloney et al. . | |
| 5,626,068 | 5/1997 | Davies | 91/276 |

OTHER PUBLICATIONS

Republic of South Africa Application No. 84/9716, 13 Dec. 1984, "A Hydraulic Reciprocating Machine".

*Primary Examiner*—F. Daniel Lopez
*Attorney, Agent, or Firm*—Foley & Lardner

[57] ABSTRACT

A hydraulic actuator has a housing, a piston drive chamber in the housing, a fluid inlet into the chamber, and a piston reciprocable in the drive chamber. The piston has diametrical steps exposed to fluid under pressure to cycle the piston. A sleeve spaced from and surrounds over a length of the piston to define a return chamber therebetween. The housing has first and second seats. The first seat and a first surface of the sleeve define an exhaust valve, which has an exhaust port, for the return chamber. The exhaust port is opened and closed by reciprocating the sleeve. The second seat and a second surface of the sleeve an inlet valve for the return chamber. Reciprocating the sleeve opens and closes the return chamber to the drive chamber. The housing also has a bore through which a portion of the sleeve reciprocates to close the exhaust valve and seal the drive chamber. The piston and the sleeve are configured so that they interact hydraulically during cycling to generate hydraulic pressure changes in the return chamber. This reciprocates the sleeve between the exhaust valve and the return chamber inlet valve to cycle the piston. The piston/sleeve configuration also hydraulically cushions the piston as it travels toward the exhaust valve.

19 Claims, 2 Drawing Sheets

HYDRAULIC ACTUATOR

This application claims the benefit of U.S. provisional application No. 60/007,562, filed Nov. 27, 1995.

FIELD OF THE INVENTION

This invention relates to cyclic hydraulic actuators and more particularly to cyclic actuators such as those used in rock drills and other mining machinery.

BACKGROUND TO THE INVENTION

Hydraulic reciprocating machines typically include a piston movable sealingly within two or more hydraulic chambers. The piston typically has stepped diameters that define annular exposed differential pressure areas on which the hydraulic fluid pressure acts. Typically one or more chambers of the machine is supplied with hydraulic fluid at supply fluid pressure and at least one other chamber, the "controlled" chamber, is alternatively supplied with hydraulic fluid at or approximating the supply pressure, and then isolated from the supply pressure and exhausted to a low pressure as the piston reciprocates between the chambers. In some schemes, two controlled chambers acting on different piston differential areas are used and these are alternatively pressurized and vented. Typically the fluid access to the controlled chamber(s) is regulated by a valve(s) and the differential areas of the piston working in conjunction with the valve(s) results in a reciprocating piston motion. Various valve arrangements and means for operating the valve(s) are known in the art; for example hydraulic actuators working in conjunction with spool valves have been in use for four or more decades.

Actuators working in conjunction with poppet valves are a more recent innovation. Krasnoff in U.S. Pat. No. 4,450,920 issued 1984 was one of the first to describe an application of poppet valves. The machine described used a "reset cycle" namely a cycle in which substantially steady supply pressure was applied to a piston area in a drive chamber resulting in a drive stroke toward the drill tool, and in which alternating pressure was applied to a larger piston exposed area in the controlled reset chamber located between the drive chamber and the drill tool. Further the patent describes the use of a rearward biased lost motion inlet valve located in the drive chamber which was hydraulically locked against a seat for part of the drive stroke until it was mechanically pulled from its seat at the extremity of the lost motion, and a rearward biased exhaust valve located in the reset chamber which was moved hydraulically into a closed position against its bias by applying fluid pressure on one face and opened by virtue of the bias once the pressure was relieved. The machine described in this patent was not developed.

The first practical use of poppet valves was set out by Burhmann in South African patent No. 84/9716. This invention featured the use of separate inlet and exhaust valves, which were opened and closed by mechanical interaction between the valves and the piston. A lost motion rearward biased exhaust valve having a long stem and an interaction shoulder moved sealingly within an inlet valve. The inlet valve regulated flow from an upstream supply chamber into the controlled drive chamber. When the inlet valve was open during the drive stroke, the exhaust valve was hydraulically locked on to an exhaust seat formed on the upstream end of the piston and led to an exhaust port through the bore of the piston. At the end of the drive stroke and by virtue of the limited lost motion, the inlet valve was closed by interaction with the shoulder on the stem of the exhaust valve and the exhaust valve was opened, both due to the breaking of the hydraulic lock on the exhaust seat and the mechanical stroke limitation set by the lost motion design. Due to the bias on the exhaust valve, it then moved backward and up against the inlet valve. The piston was biased rearward when the drive chamber was exhausted and near the end of its return stroke it mechanically interacted with the exhaust valve and simultaneously lifted the inlet valve off its seat thereby commencing the next drive cycle. Although the subject of long and intensive development this invention never saw commercial use. The two key weaknesses were the long return stroke of the exhaust valve, which resulted in unacceptable valve velocities and led to impact breakage and the exhausting through the piston bore, necessitating an exhaust accumulator.

The next major innovation in poppet valve actuators was achieved by Davies in 1991 and is described in U.S. Pat. No. 5,222,425. Davies recognized that the opening of the rearward biased exhaust valve in South African patent No. 84/9716 resulted from two simultaneous actions namely the breaking of the hydraulic lock holding the rearward biased exhaust valve on to its exhaust seat and the mechanical separation of the exhaust valve from its exhaust seat at the end of the lost motion stroke. His invention eliminated this duplication and only used the closing of an upstream valve to break the hydraulic lock holding the exhaust valve closed against its bias, and thereby eliminated the troublesome link between the exhaust valve stroke and the piston stroke. In this respect, it had similarities to the Krasnoff approach. The independent exhaust valve was stepped on its exterior surface and held in two seal/bearings on its external diameters so that a connection of the diametric step to the supply pressure resulted in a continuous rearward bias on the valve. The closure of the otherwise loose inlet valve during the drive stroke was achieved by way of a forward hydraulically biased pick up moving on the tail of the piston. Also by exhausting radially outward from the drive chamber the exhaust accumulator was eliminated. The bias force on the exhaust valve could close off the inlet supply to the drive chamber. However a separate inlet valve up stream of the drive chamber was required to break the hydraulic lock of the exhaust valve on to the exhaust seat near the end of the drive stroke and in practice the upstream face of the exhaust valve was grooved. Hydraulic rock drills based on this invention have been in commercial use for some years.

SUMMARY OF THE INVENTION

A hydraulic actuator according to the invention comprises a housing, a first or drive chamber in the housing, a hydraulic fluid inlet connected to the first or drive chamber, an elongated piston reciprocable in the first or drive chamber, and a reciprocable sleeve surrounding the piston.

According to one aspect of the invention, the piston has diametrical steps exposed to hydraulic fluid under pressure to cycle the piston during operation of the actuator. According to further aspect of the invention, the piston has a central zone with diametrical steps of reduced diameter on either side of the central zone to define drive and return piston areas exposed to hydraulic fluid under pressure to cycle the piston during operation of the actuator.

The sleeve is spaced from the piston to form a second or return chamber between the sleeve and the piston. The sleeve extends over a length of the piston, including a piston return area, or which defines the second or return chamber. The diametrical steps can include a first diametrical step to provide a piston drive area in the first or drive chamber and a second diametrical step in the second or return chamber to provide a piston return area.

The housing includes a first valve seat that defines, with a first surface of the sleeve, a fluid exhaust valve for the second or return chamber, the exhaust valve having an exhaust port that is opened and closed by reciprocating the sleeve away from and onto the seat respectively, and a second valve seat that surrounds the piston to define, with a second surface of the sleeve, an inlet valve for the second or return chamber, which inlet valve opens and closes fluid communication between the first or drive and second or return chambers by reciprocating the sleeve. According to another aspect of the invention, the housing includes first and second opposed surfaces, the first surface defining, with a first surface of the sleeve, the exhaust valve. Reciprocating the sleeve opens and closes the second or return chamber to the exhaust port from the housing, and the second surface defines, with the second surface of the sleeve, the inlet valve. Reciprocating the sleeve connects and disconnects the second or return chamber to the first or drive chamber.

The housing also includes a bore through which a portion of the sleeve sealingly reciprocates and continuously seals the exhaust valve from the first or return chamber.

The piston and the sleeve are configured to interact during cycling and generate hydraulic fluid pressure changes in the second or return chamber, during travel of the piston in a first direction, to move the sleeve and open the inlet valve and close the exhaust valve to decelerate the piston and then accelerate the piston in a second direction, which is opposite the first direction, and during travel of the piston in the second direction, to move the sleeve and close the inlet valve and open the exhaust valve to decelerate the piston in the second direction and then accelerate the piston in the first direction. According to another aspect of the invention, the piston and the sleeve are further configured to interact hydraulically in the first direction toward the exhaust valve to provide a hydraulic cushion to additionally decelerate the piston at the extremity of motion in the first direction.

According to another aspect of the invention, the first or drive chamber is divided into first and second chamber sections by a partition wall through which the central zone of the piston is sealingly reciprocable. The first chamber section houses a portion of the piston including the drive area and the second chamber section houses a portion of the sleeve projecting from the bore.

According to another aspect of the invention, a start/stop valve arrangement is provided.

According to another aspect of the invention, the sleeve is circular and has a stepped down portion located in the bore to provide a hydraulically exposed return area for the sleeve on the outside of the sleeve in the first or drive chamber.

In this specification the term "hydraulic fluid" is intended to include water, oil and emulsions of water and oil.

BRIEF DESCRIPTION OF THE DRAWINGS

The invention is now described by way of example only with reference to the drawings in which.

DETAILED DESCRIPTION OF THE PREFERRED EMBODIMENT

Figure 1:
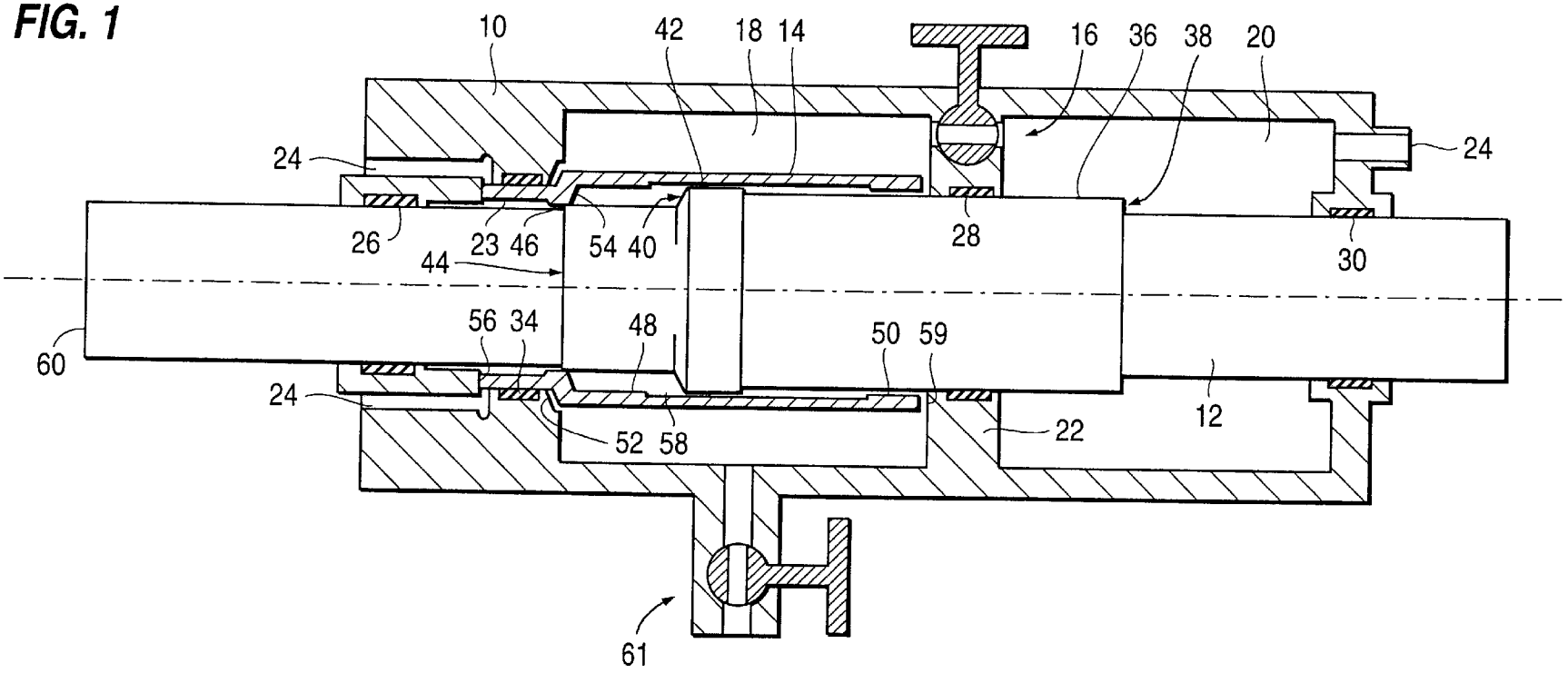
FIG. 1 is a diagrammatic sectioned side elevation of an embodiment of the actuator of the invention as used in a rock drill.

The drill actuator of the invention is shown in FIG. 1 to include a housing 10, a piston 12, a sleeve 14 and a start/stop valve 16.

The actuator housing includes a composite piston drive chamber, e.g., first chamber, which is composed of two drive chamber sections 18 and 20 separated from each other by a divider wall 22 in which the start/stop valve 16 is located. A hydraulic fluid inlet 24 is open into the drive chamber section 20. The forward end wall of the drive chamber section 18 is recessed to provide a bore 23 from which a plurality of exhaust ports 24 lead to the outside of the housing. The body additionally includes three seal bearings 26,28 and 30, which support the piston 12 and in which the piston is sealingly reciprocable. A further seal bearing 34 is located in the blind bore 23 and sealingly supports the sleeve 14 for reciprocal movement.

The piston 12 is downwardly stepped on either side of a central zone 36 to provide a hydraulically exposed piston drive area 38 in the drive chamber section 20 and a piston return area which is a combination of a portion of piston area 40 and a further stepped area 44. The piston further includes an outwardly stepped portion 42. The net return area of the piston is larger than the piston drive area.

The sleeve 14 is in the form of a stepped sleeve with its forward smaller diameter portion located in the bore 23 for reciprocatory movement on the seal bearing 34. The step in the sleeve 14 extends beyond the inner surface of the small diameter portion of the sleeve to provide an inner rib 46 in the sleeve cavity. The inner surface of the rib is just larger in diameter than the diameter of the piston portion between the piston steps 42 and 44. (The term "just" in this specification is to be taken to mean a separation distance between components which is optimally less than 0.15 mm). The central zone of the inner surface of the large diameter portion of the sleeve is recessed as shown in the drawing to provide fluid flow restrictor surfaces 48 and 50 in the sleeve cavity. The diameters of the surfaces 48 and 50 are just greater than the outer diameter of the piston step 42. The step in the sleeve wall provides, on the outside of the poppet, a hydraulically exposed sleeve return area 52 which is, during operation of the actuator, exposed to fluid under pressure in the drive chamber section 18. The net return area of the sleeve is the diametrical difference between the restrictor surface 50 and the outer diameter of the reduced diameter portion of the sleeve. The annular surface at the front end of the sleeve seats on a valve seat 56 on the traverse end wall of the bore 23 with the seat and the forward end surface of the sleeve defining an exhaust valve for the actuator. The space between the inner surface of the sleeve 14 and the outer surface of the piston defines a piston return chamber 58, i.e., second chamber. The rear annular end surface of the sleeve defines with a seat 59 on the partition wall 22 an inlet valve to the return chamber 58.

The start/stop valve 16 is, in this embodiment of the invention, a ball valve operable from the outside of the actuator body between a first position, which is shown in the drawing, to open the drive chamber section 18 to the drive chamber 20 and a second transverse position in which the chamber sections are closed to one another.

The actuator additionally includes a vent valve 61 for venting fluid at supply pressure from the drive chamber section 18 for starting as will be explained below.

The actuator, in a typical application might include a conventional pressurized gas accumulator, not shown in the drawing, which ensures that the hydraulic fluid supply pressure in the machine remains constant within acceptable limits.

In use, with the valve 16 closed, and the vent valve 61 opened to drop any fluid pressure in the chamber section 18 and the chamber 58, the fluid inlet 24 to the actuator is connected to a hydraulic hose through which the drive chamber section 20 and the actuator are charged with hydraulic fluid at supply pressure. Pressure fluid in the drive chamber section 20 acting on the piston drive area 38 drives the piston to the left in the drawing with at least the return area 40 of the piston driving hydraulic fluid in the return chamber 58 through the open exhaust ports 24 until the return area 40 on the piston engages the step area 54 on the inner surface of the sleeve to entrain the sleeve to the left in the drawing until its leading edge abuts the seat 56 to close the exhaust ports 24.

To start, the actuator the vent valve 61 is closed and the start/stop valve 16 opened to pressurize the drive chamber section 18 and the return chamber 58 with fluid at supply pressure. The fluid enters the return chamber 58 through the open inlet port to the drive chamber. The fluid pressure acting on the sleeve drive area 54 of the sleeve 14 hydraulically locks the sleeve to the exhaust seat 56 and the hydraulic pressures acting on the piston drive and return areas 38, 40 and 44 returns the piston to the right in the drawing. As the piston moves to the right and enters the reduced diameter portion 50 of the sleeve the fluid pressure in the return chamber 58 drops breaking the hydraulic lock on the exhaust valve seat 56 to force the sleeve rearwardly until the rear edge of the poppet seats on the inlet seat 59 on the divider wall 22. The return chamber 58 is vented to atmosphere through the exhaust ports 24 to cause the pressure acting on the sleeve return area to hydraulically lock the sleeve onto its inlet seat 59 to prevent fluid flow from the housing drive chamber section 18 into the return chamber 58. With the fluid pressure in the return chamber dropped the high fluid pressure acting on the piston drive area 38 in the drive chamber section 20 stops and reverses the direction of piston travel into its drive stroke.

As the piston commences its drive stroke the rapid acceleration of the piston to the left in the drawing causes the piston return areas 40 and 44 to expel hydraulic fluid in the return chamber 58 from the open exhaust ports 24 until the outward step 44 on the piston reaches the restriction surface on the rib 46 in the sleeve 14 to restrict exhaust fluid flow from the machine and to cause a fluid pressure build up in the return chamber 58 ahead of the piston return area 40. The pressure build up acting on the sleeve area 54 breaks the hydraulic lock between the sleeve and its inlet seat 59 and the net fluid force now acting on the sleeve drives the sleeve onto its exhaust seat 56. The high speed piston is now decelerated by fluid force acting on its return areas 40 and 44 until the free end 60 of the piston strikes the drill steel or until the hydraulic cushion formed between the drive area 54 of the sleeve and the return area 40 of the piston rapidly decelerates the piston.

Figure 2:
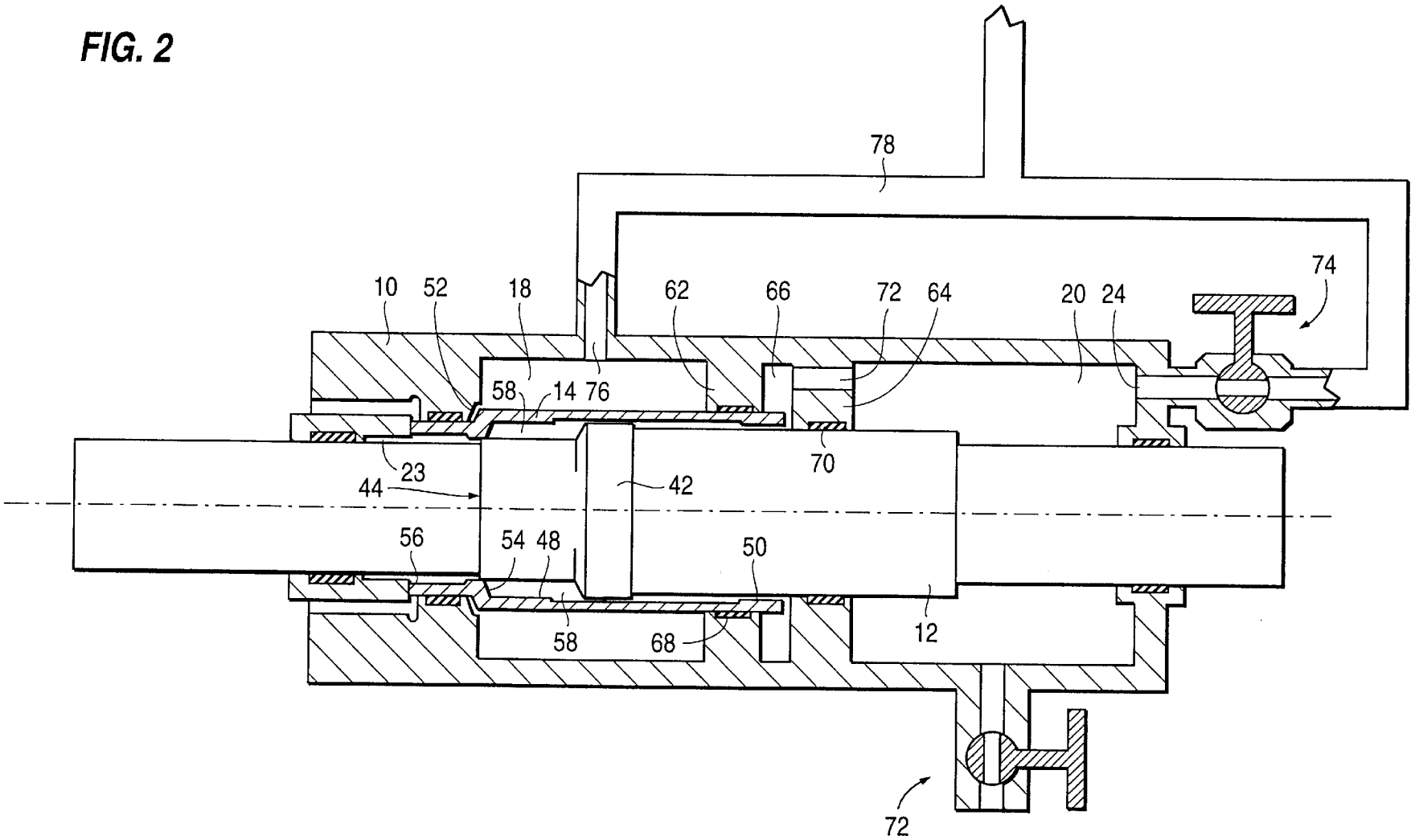
FIG. 2 is a similar view to that of the FIG. 1 actuator incorporating a variation on the stop/start arrangement of the actuator.

In the second embodiment of the drill actuator illustrated in FIG. 2 the same reference numbers as those in FIG. 1 refer to equivalent actuator components.

The principal difference between the two actuators is the starting arrangement of the FIG. 2 actuator which is more positive.

In the FIG. 2 actuator the partition 22 of FIG. 1 is divided into two partitions 62 and 64 to create what amounts to a third drive chamber section 66 in the composite first chamber of the actuator.

The partition 62 carries a seal bearing 68, which supports the sleeve 14, as shown, and together with the closed partition, isolates the drive chamber section 18 from the drive chamber sections 20 and 66. The seal bearing is only subject to a pressure difference before and during starting of the actuator. The partition 64 carries a piston seal bearing 70 which is permanently open through one or more apertures 72 between the drive chamber sections 20 and 66. In this embodiment of the invention the sleeve inlet seat 59 is located on the partition 64.

The start/stop arrangement of this actuator includes a vent valve 72 from the drive chamber section 20, the hydraulic fluid inlet 24, which carries an inlet valve 74, and a second hydraulic fluid inlet 76 into the drive chamber section 18. The inlet side of the valve 74 is connected through an open line 78 to the inlet 76, as shown in the drawing. In practice the line 78 may be built into the wall of the housing 10.

To start the actuator, which will generally be filled with hydraulic fluid under some pressure the inlet valve 74 is closed, and the vent valve is opened to drop fluid pressure in the drive chamber sections 20 and 66. The pressure fluid acting on the return area 52 of the sleeve will snap the sleeve 14 onto its inlet seat 59 to close the second chamber 58 to supply pressure fluid and to fully open the exhaust ports 24 to the return chamber. The vent valve 72 is now closed and the start/stop valve opened to cause the piston 12 to be accelerated to the left in the drawing as described with reference to FIG. 1. To stop the actuator the valve 74 is merely closed to stall the piston.

I claim:

1. A hydraulic actuator comprising:

a housing;

a first chamber in the housing;

a hydraulic fluid inlet connected to the first chamber;

an elongated piston reciprocable in the first chamber, wherein the piston has diametrical steps exposed to hydraulic fluid under pressure to cycle the piston during operation of the actuator;

a reciprocable sleeve surrounding the piston, the sleeve being spaced from the piston to form a second chamber between the sleeve and the piston, wherein the sleeve extends over a length of the piston, including a piston return area, wherein the housing includes a first valve seat that defines, with a first surface of the sleeve, a fluid exhaust valve for the second chamber, the exhaust valve having an exhaust port that is opened and closed by reciprocating the sleeve away from and onto the seat respectively, and a second valve seat that surrounds the piston to define, with a second surface of the sleeve, an inlet valve for the second chamber, which inlet valve opens and closes fluid communication between the first and second chambers by reciprocating the sleeve, wherein the housing includes a bore through which a portion of the sleeve sealingly reciprocates and continuously seals the exhaust valve from the first chamber, and wherein the piston and the sleeve are configured to interact during cycling and generate hydraulic fluid pressure changes in the second chamber, during travel of the piston in a first direction, to move the sleeve and open the inlet valve and close the exhaust valve to decelerate the piston and then accelerate the piston in a second direction, which is opposite the first direction, and during travel of the piston in the second direction, to move the sleeve and close the inlet valve and open the exhaust valve to decelerate the piston in the second direction and then accelerate the piston in the first direction.

2. An actuator as claimed in claim 1, wherein the piston includes a central zone with the diametrical steps of reduced diameter on either side of the central zone to define exposed drive and return piston areas.

3. An actuator as claimed in claim 1, wherein the exhaust port extends from the bore to the outside of the housing, and wherein the first valve surface of the sleeve is a transverse end surface of the sleeve and the first valve seat is situated on an end surface of the bore.

4. A hydraulic actuator comprising:

a housing;

a first chamber in the housing;

a hydraulic fluid inlet connected to the first chamber;

an elongated piston reciprocable in the first chamber, wherein the piston has a central zone with diametrical steps of reduced diameter on either side of the central zone to define drive and return piston areas exposed to hydraulic fluid under pressure to cycle the piston during operation of the actuator;

a reciprocable sleeve surrounding the piston, the sleeve being spaced from the piston to form a second chamber between the sleeve and the piston, wherein the housing includes a first valve seat that defines, with a first surface of the sleeve, a fluid exhaust valve for the second chamber, the exhaust valve having an exhaust port that is opened and closed by reciprocating the sleeve away from and onto the seat respectively, and a second valve seat that surrounds the piston to define, with a second surface of the sleeve, an inlet valve for the second chamber, which inlet valve opens and closes fluid communication between the first and second chambers by reciprocating the sleeve, wherein the housing includes a bore through which a portion of the sleeve sealingly reciprocates and continuously seals the exhaust valve from the first chamber, wherein the piston and the sleeve are configured to interact during cycling and generate hydraulic fluid pressure changes in the second chamber, during travel of the piston in a first direction, to move the sleeve and open the inlet valve and close the exhaust valve to decelerate the piston and then accelerate the piston in a second direction, which is opposite the first direction, and during travel of the piston in the second direction, to move the sleeve and close the inlet valve and open the exhaust valve to decelerate the piston in the second direction and then accelerate the piston in the first direction, and wherein the first chamber is divided into first and second chamber sections by a partition wall through which the central zone of the piston is sealingly reciprocable, with the first chamber section housing a portion of the piston including the drive area, the second chamber section housing a portion of the sleeve projecting from the bore; and a start/stop valve arrangement.

5. An actuator as claimed in claim 4, wherein the start/stop valve arrangement is a valve located in the partition wall and operable from the outside of the housing to connect or disconnect the first and second chamber sections from each other through the wall.

6. An actuator as claimed in claim 5, further including a hydraulic fluid vent valve for venting fluid in the second chamber section.

7. An actuator as claimed in claim 4, wherein the second valve surface of the sleeve is a transverse free end surface of the sleeve and the second valve seat is located in the partition wall surrounding the piston.

8. An actuator as claimed in claim 4, further including a bearing in the first chamber for sealingly supporting the sleeve for reciprocable movement.

9. An actuator as claimed in claim 8, wherein the partition wall consists of first and second spaced partitions that define a third chamber section therebetween, the first partition is a wall that separates the second and third chamber sections from each other and carries the bearing that sealingly supports the sleeve, and the second partition wall carries a seal bearing sealingly supporting the piston, the second partition communicating the first and third chamber sections and including the second valve seat, which with a transverse free end surface, defines the second chamber inlet valve, and further including hydraulic supply fluid inlets to the first and second chamber sections.

10. An actuator as claimed in claim 9, further including an on/off valve in the inlet to the first chamber section for opening and closing the first chamber section to hydraulic fluid at supply pressure to start and stop the actuator and a vent valve for the first chamber section.

11. A hydraulic actuator comprising:

a housing;

a first chamber in the housing;

a hydraulic fluid inlet connected to the first chamber;

an elongated piston reciprocable in the first chamber, wherein the piston has a central zone with diametrical steps of reduced diameter on either side of the central zone to define drive and return piston areas exposed to hydraulic fluid under pressure to cycle the piston during operation of the actuator;

a reciprocable sleeve surrounding the piston, the sleeve being spaced from the piston to form a second chamber between the sleeve and the piston, wherein the housing includes a first valve seat that defines, with a first surface of the sleeve, a fluid exhaust valve for the second chamber, the exhaust valve having an exhaust port that is opened and closed by reciprocating the sleeve away from and onto the seat respectively, and a second valve seat that surrounds the piston to define, with a second surface of the sleeve, an inlet valve for the second chamber, which inlet valve opens and closes fluid communication between the first and second chambers by reciprocating the sleeve, wherein the housing includes a bore through which a portion of the sleeve sealingly reciprocates and continuously seals the exhaust valve from the first chamber, wherein the piston and the sleeve are configured to interact during cycling and generate hydraulic fluid pressure changes in the second chamber, during travel of the piston in a first direction, to move the sleeve and open the inlet valve and close the exhaust valve to decelerate the piston and then accelerate the piston in a second direction, which is opposite the first direction, and during travel of the piston in the second direction, to move the sleeve and close the inlet valve and open the exhaust valve to decelerate the piston in the second direction and then accelerate the piston in the first direction, and wherein the sleeve is circular and has a stepped down portion located in the bore to provide a hydraulically exposed return area for the sleeve on the outside of the sleeve in the first chamber.

12. An actuator as claimed in claim 11, wherein an inner wall of the larger diameter portion of the sleeve is recessed to a larger diameter over a length portion between the step in the sleeve and a free end of the sleeve, with the central zone of the piston in the sleeve including a stepped portion stepped outwardly from the central zone of the piston to a diameter just less than the non-recessed portions of the sleeve wall at either end of the recess.

13. An actuator as claimed in claim 11, wherein the reduced diameter portion on the return area side of the piston is again stepped to a further reduced diameter portion reciprocal in the bore and the sleeve has an inner diameter reduced to just greater than the outer diameter of the further diametrically reduced portion of the piston.

14. A hydraulic actuator comprising:

a housing;

a drive chamber in the housing;

a hydraulic fluid inlet connected to the drive chamber;

an elongated piston reciprocable in the housing, wherein the piston has a first diametrical step to provide a piston drive area in the drive chamber and a second diametrical step;

a reciprocable sleeve surrounding the piston, the sleeve being spaced from the piston to form a return chamber between the sleeve and the piston, the sleeve extending over a length of the piston, which defines the return chamber, wherein the second diametrical step is in the return chamber to provide a piston return area, wherein the housing includes first and second opposed surfaces, the first surface defining, with a first surface of the sleeve, a fluid exhaust valve, reciprocating the sleeve opens and closes the return chamber to an exhaust port from the housing, and the second surface defines, with a second surface of the sleeve, an inlet valve, reciprocating the sleeve connects and disconnects the return chamber to the drive chamber, wherein the housing includes a bore in a wall thereof, a portion of the sleeve being sealingly reciprocable therein to continuously seal the exhaust valve from drive chamber, wherein the piston and the sleeve are configured to interact during cycling and generate hydraulic fluid pressure changes in the return chamber, during travel of the piston in a first direction, to move the sleeve and open the inlet valve and close the exhaust valve to decelerate the piston and then accelerate the piston in a second direction, which is opposite the first direction, and during travel of the piston in the second direction, to move the sleeve and close the inlet valve and open the exhaust valve to decelerate the piston in the second direction and then accelerate the piston in the first direction, and further configured to interact hydraulically in the first direction toward the exhaust valve to provide a hydraulic cushion to additionally decelerate the piston at the extremity of motion in the first direction.

15. An actuator as claimed in claim 14, wherein the sleeve is circular and has a stepped down portion located in the bore to provide a hydraulically exposed return area for the sleeve on the outside of the sleeve in the drive chamber.

16. An actuator as claimed in claim 14, wherein the drive chamber is divided into first and second drive chamber sections by a partition wall that carries a bearing in which the piston is sealingly reciprocable, with the first drive chamber section housing a portion of the piston including the drive area, the second drive chamber section housing a portion of the sleeve projecting from the bore, and further including a start/stop valve arrangement for hydraulically connecting or disconnecting the first and second drive chamber sections.

17. An actuator as claimed in claim 16, further including a hydraulic fluid vent valve from the second drive chamber section.

18. An actuator as claimed in claim 16, wherein the partition wall consists of first and second partitions spaced from each other in an axial direction of the piston, the first and second partitions defining a third chamber section therebetween, the first partition is a wall that separates the second and third drive chamber sections from each other and carries a seal bearing that sealingly supports the sleeve, and the second partition wall carries the bearing that sealingly supporting the piston, the second partition communicating the first and third chamber sections and including the second housing surface, which with the second surface of the sleeve, defines the inlet valve, and further including hydraulic supply fluid inlets to the first and second chamber sections.

19. An actuator as claimed in claim 18, further including an on/off valve in the inlet to the first chamber section for opening and closing the first chamber section to hydraulic fluid at supply pressure to start and stop the actuator and a vent valve for the first chamber section.

* * * * *